US010985500B2

(12) United States Patent
Grandcoing

(10) Patent No.: US 10,985,500 B2
(45) Date of Patent: Apr. 20, 2021

(54) CONNECTOR ASSEMBLY

(71) Applicant: NICOMATIC, Bons en Chablais (FR)

(72) Inventor: Christophe Grandcoing, Bons en Chablais (FR)

(73) Assignee: NICOMATIC, Bons en Chablais (FR)

( * ) Notice: Subject to any disclaimer, the term of this patent is extended or adjusted under 35 U.S.C. 154(b) by 0 days.

(21) Appl. No.: 16/494,066

(22) PCT Filed: Mar. 14, 2018

(86) PCT No.: PCT/EP2018/056459

§ 371 (c)(1),
(2) Date: Sep. 13, 2019

(87) PCT Pub. No.: WO2018/167181

PCT Pub. Date: Sep. 20, 2018

(65) Prior Publication Data

US 2020/0136309 A1 Apr. 30, 2020

(30) Foreign Application Priority Data

Mar. 15, 2017 (FR) ..... 1752125

(51) Int. Cl.
*H01R 13/627* (2006.01)
*H01R 13/631* (2006.01)
*H01R 13/645* (2006.01)

(52) U.S. Cl.
CPC ..... *H01R 13/6278* (2013.01); *H01R 13/631* (2013.01); *H01R 13/645* (2013.01)

(58) Field of Classification Search
CPC . H01R 13/6278; H01R 13/631; H01R 13/645
USPC ..... 439/378
See application file for complete search history.

(56) References Cited

U.S. PATENT DOCUMENTS 4,109,987 A 8/1978 Bourdon
6,193,539 B1 * 2/2001 Chang ..... H01R 13/6278 439/346
8,177,575 B2 * 5/2012 Katagiyama ..... H01R 13/625 439/345
9,075,205 B2 * 7/2015 Pepe ..... H01R 24/64
(Continued)

FOREIGN PATENT DOCUMENTS

FR 2 349 055 11/1977
WO WO 2016/168389 A1 10/2016

OTHER PUBLICATIONS

International Search Report dated Jul. 10, 2018 in PCT/EP2018/056459 filed on Mar. 14, 2018.

*Primary Examiner* — Hien D Vu
(74) *Attorney, Agent, or Firm* — Oblon, McClelland, Maier & Neustadt, L.L.P.

(57) ABSTRACT

A connector assembly is provided, including a plug including a plug casing defining a housing, and a plug polarizing socket arranged in the housing; a base including a base casing configured to be assembled with the plug casing, the base casing including a base polarizing pin matching the plug polarizing socket and configured to fit together with the plug polarizing pin during assembly of the plug and base casings; and a snap-fitting component supported by the base polarizing pin and by the plug casing, and configured to be activated when the base polarizing pin is in an end of travel position in the housing of the plug casing.

12 Claims, 4 Drawing Sheets

(56) References Cited

U.S. PATENT DOCUMENTS

| | | | | |
|---|---|---|---|---|
| 9,685,742 | B2 * | 6/2017 | Liu | H01R 13/7037 |
| 2012/0071017 | A1 * | 3/2012 | Gaul | G07F 15/005 439/304 |
| 2014/0016902 | A1 | 1/2014 | Pepe et al. | |
| 2015/0346436 | A1 | 12/2015 | Pepe et al. | |
| 2016/0308304 | A1 | 10/2016 | Miller et al. | |

* cited by examiner

Fig.1a
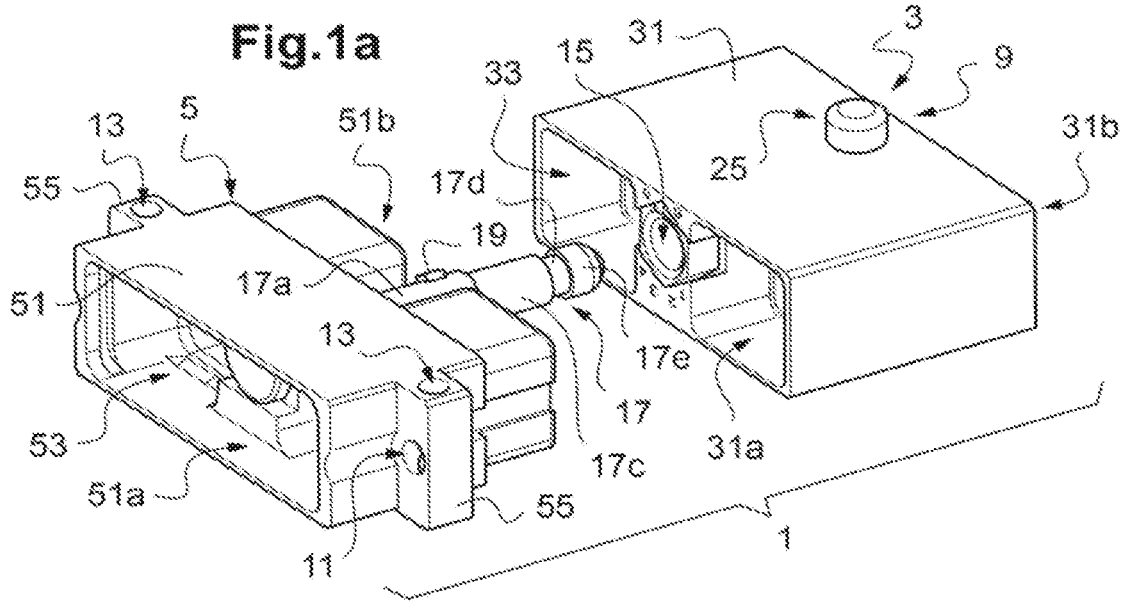
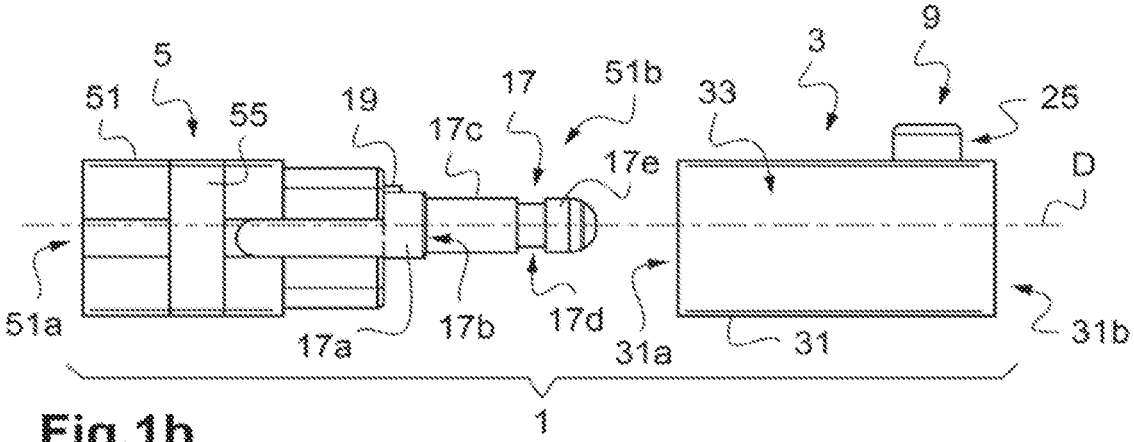
Fig.1b
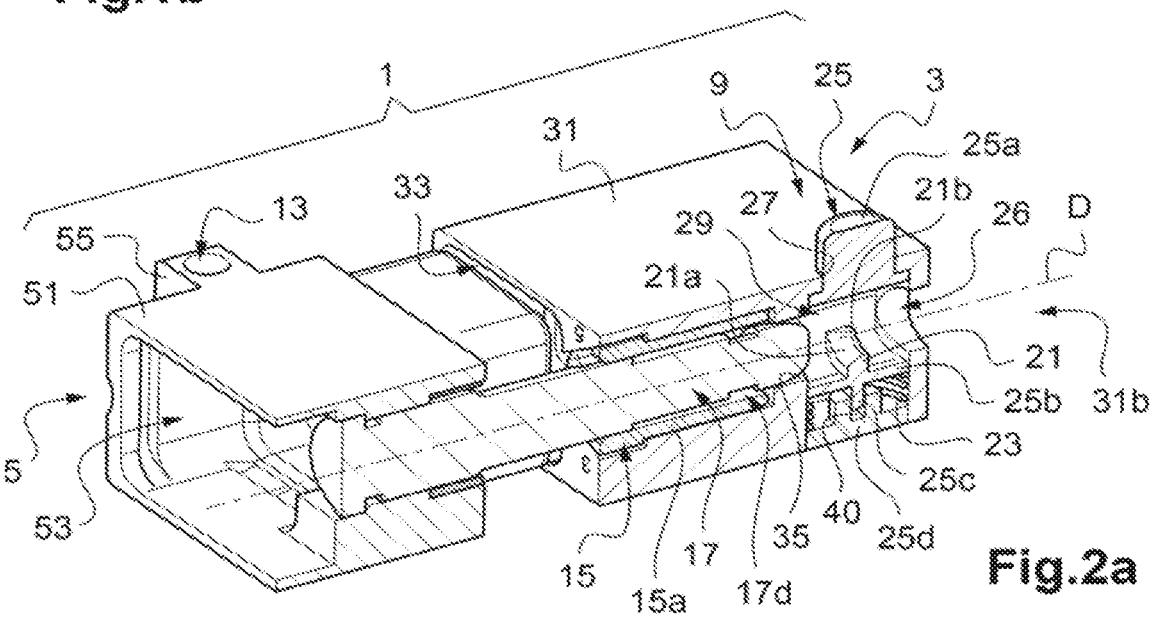
Fig.2a

Fig.2e
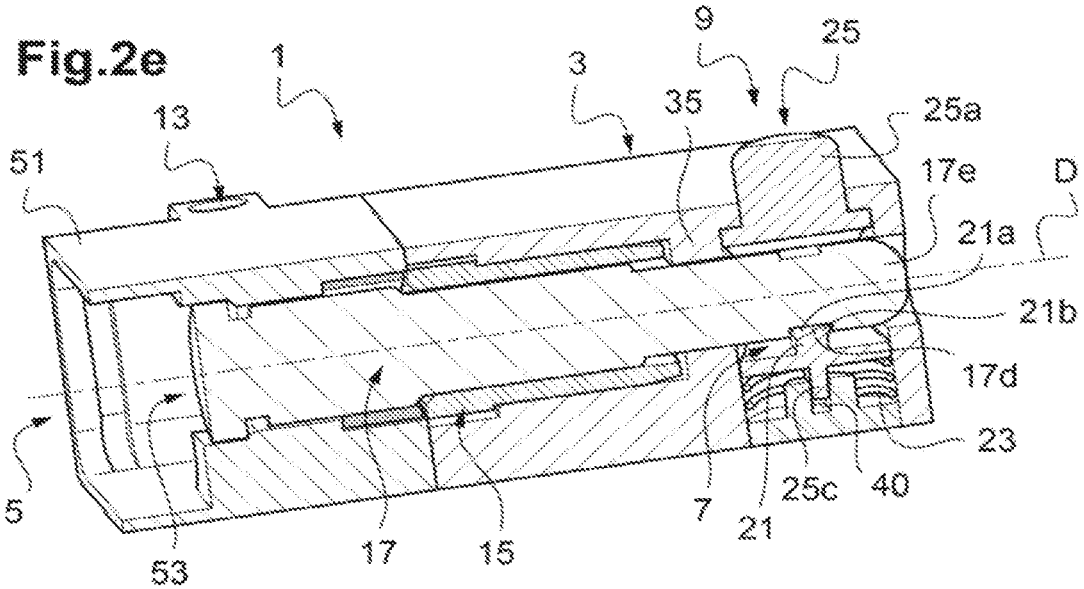
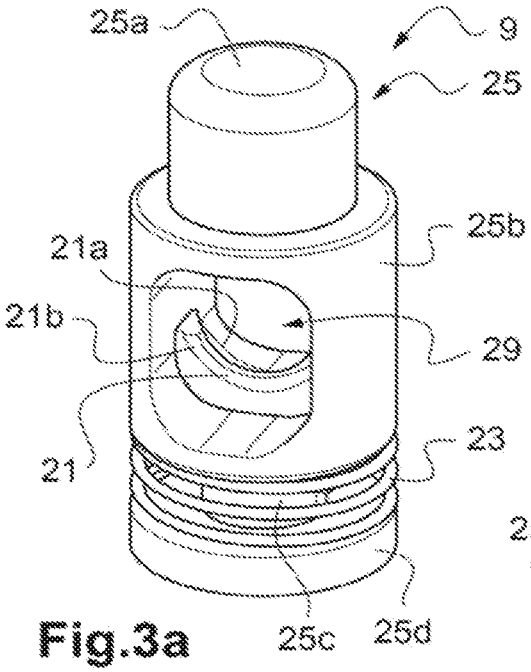
Fig.3a
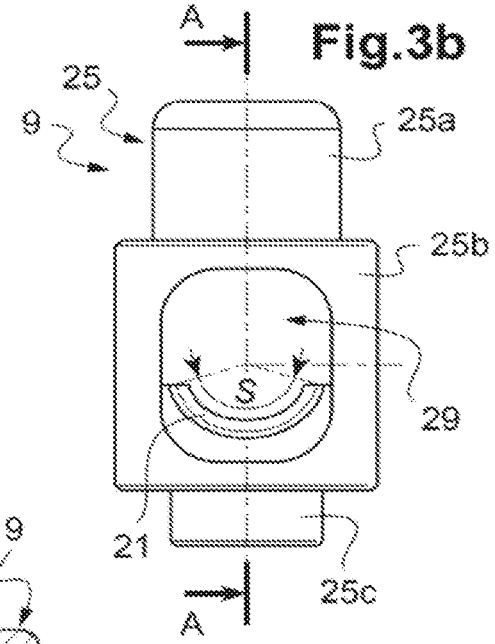
Fig.3b
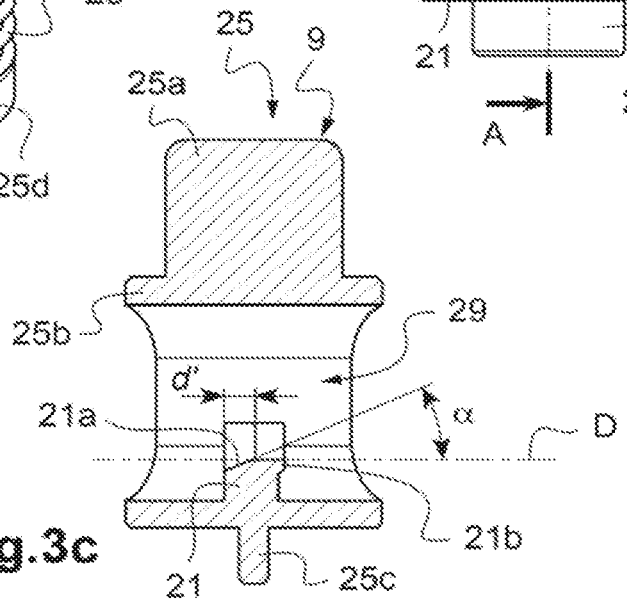
Fig.3c

CONNECTOR ASSEMBLY

BACKGROUND

The invention relates to a connector assembly called modular assembly. The invention also relates to the method for connecting and disconnecting such a connector assembly.

In particular, such a connector assembly can be used, for example, for aerospace applications as well as for military and even aeronautical applications. Such a connector assembly must be able to withstand high mechanical stresses. In a known manner, in particular according to standard EN4165, these connector assemblies comprise base and plug casings that can be assembled or coupled together. The casings respectively comprise matching electric contacts allowing electrical connection when the base and plug casings are assembled. Electric cables and/or accessories can be provided at the rear of the plug casing. The connector assembly is locked by screwing, by means of a coupling screw housed in the plug casing and by a coupling nut provided in the base casing. The coupling screw and nut are generally arranged centrally. The screw can be accessed from the rear of the plug casing, i.e. from the side opposite the side facing the base casing.

The coupling nut in the base casing also provides a polarization function for correct positioning relative to the plug casing. This coupling nut is known as coding pin or a polarization pin. The plug casing further comprises the coupling screw, a central socket, also called coding pin or polarization pin, fixed in the plug casing, which also provides the polarization function. Assembling casings by screwing is a tedious operation, which increases the assembly time of these connector assemblies. Furthermore, the cables at the output of the plug casing hinder access to the screw, which is therefore difficult to handle with two fingers, in particular with the index finger and the thumb.

BRIEF SUMMARY

Therefore, the aim of the invention is to propose a connector assembly with improved assembly efficiency.

To this end, the aim of the invention is a connector assembly comprising:

- a plug comprising a plug casing defining a housing, and a plug polarizing means arranged in the housing; and
- a base comprising a base casing configured to be assembled with the plug casing, the base casing comprising a base polarizing means matching the plug polarizing means and configured to fit together with the plug polarizing means during the assembly of the plug and base casings.

According to the invention, said assembly further comprises a snap-fitting mechanism supported, on the one hand, by the base polarizing means and, on the other hand, by the plug casing, and configured to be activated when the base polarizing means is in an end of travel position in the housing of the plug casing.

Such a snap-fitting mechanism allows the casings to be simply locked in a coupled position without involving complex manipulation or operation and allows unintentional uncoupling of the casings to be counteracted.

More specifically, it involves an automatic snap-fitting mechanism.

Said connector assembly can further comprise one or more of the following features, taken separately or in combination:

- the snap-fitting mechanism comprises matching snap-fitting elements supported, on the one hand, by the base polarizing means and, on the other hand, by the plug casing;
- the snap-fitting mechanism comprises at least one return component configured to urge one of the snap-fitting elements to a position, called engagement position, allowing engagement with the matching snap-fitting element when the base polarizing means is in the end of travel position;
- said at least one return component is configured to urge the snap-fitting element supported by the plug casing to the engagement position, in which said snap-fitting element is projecting into the passage of the base polarizing means in the plug casing so that on assembly the base polarizing means is configured to press on said snap-fitting element and to continue its course;
- said at least one return component is a helical spring configured to be compressed when the base polarizing means presses on the snap-fitting element during assembly;
- the plug casing further comprises a guide for guiding the base polarizing means toward the end of travel position;
- the guide is a linear guide for guiding the base polarizing means in the housing of the plug casing;
- the base polarizing means is configured to fit together with the plug polarizing means by translation movement in an assembly direction;
- the snap-fitting elements are configured to mutually engage radially relative to the assembly direction when the base polarizing means is in the end of travel position;
- the snap-fitting elements comprise at least one snap-fitting projection and one matching snap-fitting groove;
- the snap-fitting projection is configured to engage in the snap-fitting groove when the base polarizing means is in the end of travel position;
- the snap-fitting projection can move between the engagement position, in which the snap-fitting projection is projecting into the passage of the base polarizing means, and a disengagement position, in which the snap-fitting projection releases the passage of the base polarizing means;
- the shape of the snap-fitting projection matches the shape of the snap-fitting groove;
- the snap-fitting projection is supported by the plug casing and the snap-fitting groove is formed on the base polarizing means;
- the base polarizing means has an outer profile of cylindrical shape;
- the snap-fitting projection has a curved shape matching the shape of the snap-fitting groove produced on the cylindrical periphery of the base polarizing means;
- the snap-fitting projection comprises an inlet portion configured to be the first portion of the snap-fitting projection in contact with the end of the base polarizing means during assembly and designed to conform to the shape of the end of the base polarizing means;
- the snap-fitting projection comprises a retention portion configured to come into abutment against an inner wall of the base polarizing means demarcating the snap-fitting groove, under the thrust of said at least one return component, so as to limit the translation travel of the base polarizing means;

the inlet portion has a frustoconical surface;

the retention portion has a cylindrical surface;

the frustoconical surface is generated by a generating line forming an angle of less than 45°, preferably of the order of 15° to 35°, with the assembly direction;

the cylindrical surface is generated by a generating line parallel to the assembly direction;

the snap-fitting projection extends over an angular sector of the order of 146°;

said assembly further comprises a mechanism for uncoupling the base casing and the plug casing, comprising at least one pushbutton freely mounted in the plug casing and arranged partially projecting on the plug casing so as to be able to be activated from outside the connector assembly;

said at least one pushbutton is freely mounted radially relative to the direction for assembling the base polarizing means in the plug casing;

said at least one pushbutton comprises an activation zone arranged projecting on the plug casing;

said at least one pushbutton comprises a body arranged inside the plug casing and having an orifice configured to receive the end of the base polarizing means in the end of travel position;

said at least one pushbutton has a shoulder between the activation zone and the body of said at least one pushbutton;

said at least one pushbutton belongs to the snap-fitting mechanism;

said at least one return component and the snap-fitting projection belong to said at least one pushbutton;

said at least one return component is mounted on the body of said at least one pushbutton opposite the activation zone;

said at least one return component is fastened, on the one hand, to the body of said at least one pushbutton and, on the other hand, to the plug casing;

said at least one return component in the form of a helical spring is connected by one end to the body of said at least one pushbutton and by another end to a base plate;

the base plate is fixedly mounted in the plug casing or forms part of the plug casing;

the connector assembly comprises a guide for translationally guiding the pushbutton in an opening of the plug casing;

the base plate has a groove forming a guide for a protuberance of the pushbutton;

the pushbutton and the walls of the plug casing demarcating the opening have matching flat shapes forming a guide;

the plug polarizing means is produced in the form of a socket and the base polarizing means is produced in the form of a pin, which is configured in order to be received inside the socket when the casings are coupled together;

the base casing and/or the plug casing comprise detachable electric contacts configured to fit together with corresponding electric contacts of the matching casing when the casings are coupled together.

BRIEF DESCRIPTION OF THE DRAWINGS

Further features and advantages of the invention will become more clearly apparent upon reading the following description, which is provided by way of a non-limiting illustrative example, and from the accompanying drawings, in which:

FIG. 1*a* is an exploded perspective view of a connector assembly according to the invention comprising a base and a matching plug according to a first alternative embodiment;

FIG. 1*b* is an exploded side view of the connector assembly of FIG. 1*a;*

FIG. 2*a* is a perspective view showing a first step of assembling matching polarizing means of the base and of the plug;

FIG. 2*e* is a perspective view of the base and of the plug assembled and locked;

FIG. 3*a* is a perspective view of the pushbutton;

FIG. 3*b* is a front view of the pushbutton of FIG. 3*a;*

FIG. 3*c* is a section view along the A-A axis of FIG. 3*b;*

DETAILED DESCRIPTION

Figure 2B:
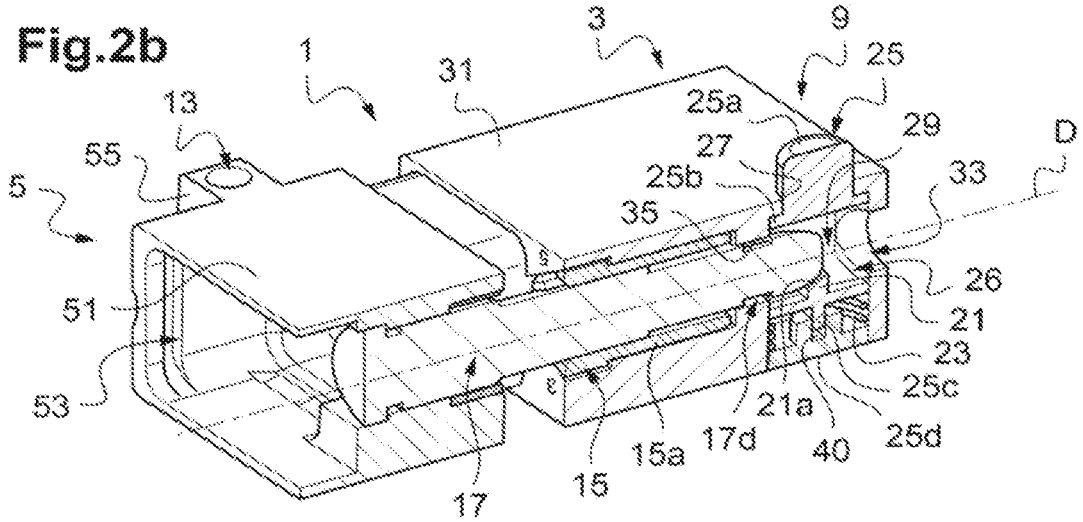
FIG. 2*b* is a perspective view showing a second assembly step, in which the end of the base polarizing means engages the orifice of a pushbutton provided on the plug.

Throughout these figures, identical elements use the same reference signs. The following embodiments are examples. Even though the description refers to one or more embodiments, this does not necessarily mean that each reference relates to the same embodiment, or that the features only apply to a single embodiment. Simple features of various embodiments can also be combined or interchanged in order to provide other embodiments. Throughout the description, some elements can be indexed, such as, for example, first element or second element. In this case, it is simple indexing for differentiating and denoting elements that are similar but not identical. This indexing does not imply a priority of one element over another and such denominations can be easily interchanged without departing from the scope of the present description. This indexing also does not imply a time order.

Connector Assembly

The invention relates to a connector assembly 1, in particular for an aerospace application. FIGS. 1*a* and 1*b* show a connector assembly 1 before assembly. This connector assembly 1 comprises a plug 3 and a base 5. The plug 3 comprises a plug casing 31 and the base 5 comprises a base casing 51 configured to be assembled with the plug casing 31. FIGS. 2*a* to 2*e* show a sequence of assembling the plug casing 31 with the base casing 51. FIGS. 1*a* to 2*e* show a first alternative embodiment of the plug casing 31.

Figure 2C:
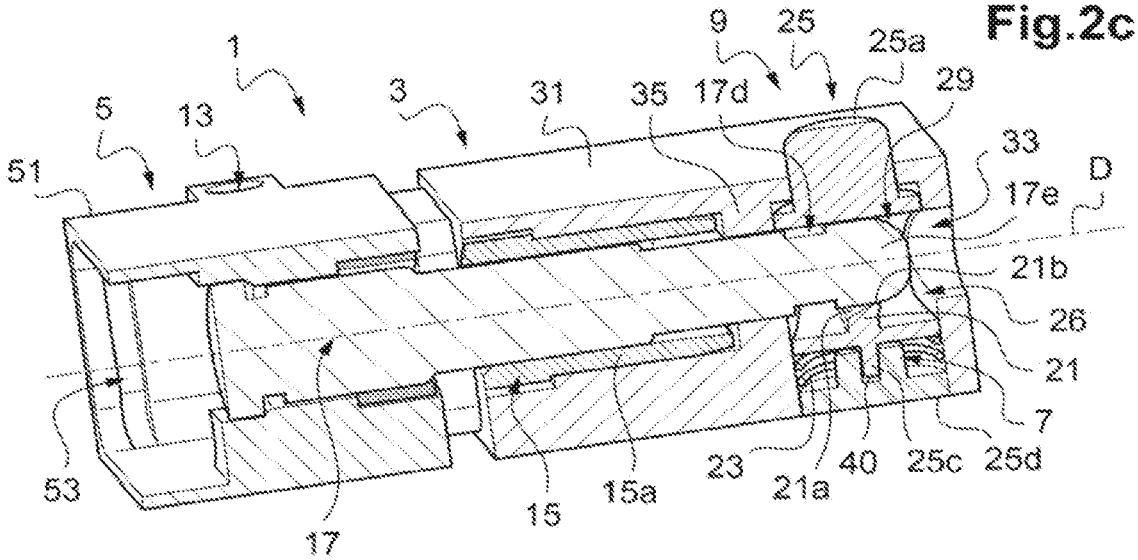
FIG. 2*c* is another perspective view showing a third assembly step, in which the end of the base polarizing means slides on a snap-fitting projection.
Figure 2D:
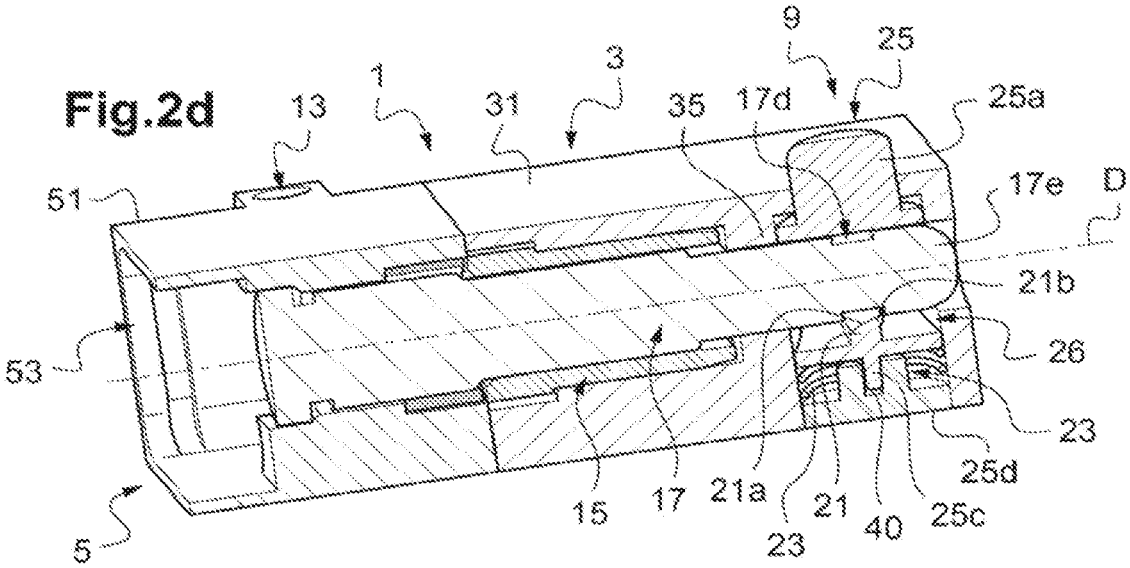
FIG. 2*d* is yet another perspective view showing a fourth assembly step, in which the snap-fitting projection is facing a snap-fitting groove on the base polarizing means.

The connector assembly 1 further comprises a snap-fitting mechanism 7, more clearly shown in FIGS. 2*c* to 2*e*, allowing the plug casing 31 and the base casing 51 to be locked in a coupled position. This snap-fitting mechanism 7 is described in further detail hereafter. The connector assembly 1 also comprises a mechanism 9 for uncoupling the base casing 51 and the plug casing 31, also described in further detail hereafter.

Again, with reference to FIGS. 1*a*, 1*b*, each casing 31, 51, respectively, comprises an outer shell that is metal, for example, such as aluminum alloy. The casings 31, 51, respectively, each have a housing 33, 53, respectively, in which modules (not shown in the figures) are particularly intended to be received, which modules are generally equipped with isolating inserts provided with electric contacts (not shown in the figures). The female contacts define the female module and the male contacts define the male module. The modules are interchangeable in the cavities of the housing 33 or 53 of the casing 31 or 51 in various configurations.

The casings 31, 51 are, in a known manner, produced in the form of one-piece casings. The casings 31, 51 are in the general shape of a parallelepiped. The plug casing 31 has a front face 31*a* arranged facing the base casing 51 in the assembled state of the connector assembly 1, and an opposite rear face 31*b*. Similarly, the base casing 51 has a front face 51*a* and an opposite rear face 51*b* arranged facing the plug casing 31 in the assembled state of the connector assembly 1.

The base casing 51 can also comprise end lugs 55 for assembling to a support, such as a panel, or to allow stacking with other base casings. To this end, through-holes 11 are provided to allow assembly on a panel and side-holes 13 are provided to allow assembly by stacking. Of course, as a variant, the base casing 51 can comprise a rectangular collar (not shown) for enabling the assembly thereof. The maximum height of the casings 31, 51 can be of the order of 15.10 mm.

With reference to FIG. 1*a*, in order to prevent any errors in assembling the plug 3 on the base 5, the plug 3 and the base 5 respectively comprise a polarizing means 15, 17. To facilitate reading, the polarizing means supported by the plug 3 is called plug polarizing means 15 and the polarizing means supported by the base 5 is called base polarizing means 17. The plug polarizing means 15 is arranged in the housing 33 defined by the plug casing 31.

More specifically, the plug polarizing means 15 is fastened in the housing 33, for example, by clipping or snap-fitting to the inner walls of the plug casing 31 demarcating the cavity for receiving the plug polarizing means 15.

According to the embodiment that is described, the plug polarizing means 15 is produced in the form of a socket. This socket 15 is also called coding socket or even polarization key. The socket 15 is arranged at the front of the plug casing 31 in order to be accessible from the front face 31*a* of the plug casing 31 and allow the base polarizing means 17 to be fitted in the socket 15. In particular, it is a central socket 15. More specifically, the socket 15 is arranged centrally in the lengthwise direction of the plug casing 31 and in the heightwise direction of the plug casing 31, the socket 15 is offset, for example, by being arranged further toward the top relative to the arrangement of the elements as shown in FIG. 1*a*. With reference to FIGS. 2*a* to 2*e*, the section of the socket 15 changes. In particular, the socket 15 has a thin section 15*a* extending inside the plug casing 31, once the socket 15 is mounted on the plug casing 31. The plug casing 31 comprises one or more stops 35 for stopping the socket 15 in the housing 33. Such a socket 15 or polarization key is known from the prior art, in particular according to standard EN4165, and is not described in further detail herein. Throughout the remainder of the description, the socket 15 will be referred to as a plug polarizing means; of course, the invention can be applied to any other type of polarizing means.

The base polarizing means 17 matches the plug polarizing means 15. The base polarizing means 17 is configured to fit together with the plug polarizing means 15 during the assembly of the plug 31 and base 51 casings. According to the embodiment that is described, the base polarizing means 17 is produced in the form of a pin, hereafter denoted using reference sign 17. Reference is also made to a polarization pin. The pin 17 is intended and is configured to be received inside the socket 15 when the casings 31, 51 are coupled together.

In a complementary manner to the socket 15, it can be a central pin 17. More specifically, with reference to FIGS. 1*a* and 1*b*, the pin 17 is arranged centrally in the lengthwise direction of the base casing 51 and, in the heightwise direction of the base casing, the pin 17 is offset, for example, by being arranged further toward the top relative to the arrangement of the elements as shown in FIG. 1*a* or 1*b*.

The pin 17 has an outer profile of generally cylindrical or similar shape, i.e. close to the cylindrical shape. At least one keyway 19 is advantageously arranged on the outer surface of the pin 17 to provide the polarization function.

As is more clearly shown in FIG. 1*b*, the pin 17 has, for example, a first part 17*a* produced with similar dimensions to the central coupling nut provided in the solutions of the prior art in order to implement the polarization. The first part 17*a* can have a maximum length of the order of 12.62 mm. The keyway 19 can be arranged on the outer surface of this first part 17*a* of the pin 17. The pin 17 can have a shoulder 17*b* and a second part 17*c* produced in the extension of the first part 17*a*. The second part 17*c* is thin and therefore in this case has a diameter that is less than that of the first part 17*a*. The pin 17 also has a groove 17*d* acting as a snap-fitting groove 17*d*, as will be described in further detail hereafter. Finally, the pin 17 has an end 17*e*. By way of a non-limiting example, the end 17*e* has a spherical shape or a shape close to the shape of a sphere.

The whole pin 17 can have, for example, a length of the order of 25 to 28 mm, preferably of the order of 27.60 mm.

Throughout the remainder of the description, the pin 17 will be referred to as a base polarizing means; of course, the invention can be applied to any other type of polarizing means.

The pin 17 is configured to fit together with the socket 15. To this end, as is more clearly shown in FIG. 2*a*, the pin 17 is guided by the socket 15 and by the one or more stops 35. In other words, the plug casing 31 further comprises a guide for guiding the base polarizing means, in this case the pin 17, toward an end of travel position in the housing 33 of the plug casing 31, shown in FIG. 2*e*. According to the embodiment that is described, the pin 17 is guided linearly. More specifically, assembling the pin 17 with the socket 15, and therefore assembling the two casings 31, 51, occurs through a translation movement in an assembly direction D.

More specifically, with respect to the snap-fitting mechanism 7 (see FIG. 2*e*), said mechanism allows the plug 31 and base 51 casings to be locked in the assembled or coupled position. The snap-fitting mechanism 7 is also designed to oppose unintentional uncoupling of the casings 31, 51. More specifically, it is an automatic snap-fitting mechanism 7, i.e. not requiring any additional manipulation with respect to the operation for assembling the two plug 31 and base 51 casings. According to the embodiment that is described, the snap-fitting mechanism 7 is supported, on the one hand, by the pin 17 of the base 5 and, on the other hand, by the plug casing 31. More specifically, the snap-fitting mechanism 7 comprises matching snap-fitting elements supported, on the one hand, by the pin 17 and on other hand, by the plug casing 31. In particular, in this example with axial assembly of the pin 17 in the plug casing 31 in the assembly direction D, the snap-fitting elements are advantageously provided to mutually engage radially relative to the assembly direction D, when the pin 17 is in the end of travel position.

According to the illustrated example, the snap-fitting elements comprise at least one snap-fitting projection 21 and one matching snap-fitting groove 17*d*. The snap-fitting projection 21 is configured to engage in the snap-fitting groove 17*d* when the pin 17 is in the end of travel position. The snap-fitting projection 21 is able to move between the engagement position (see FIGS. 2*a*, 2*e*), in which it projects into the passage of the pin 17 inside the plug casing 31, and a disengagement position (see FIGS. 2*c*, 2*d*), in which the snap-fitting projection 21 releases the passage of the pin 17. The shape of the snap-fitting projection 21 matches the shape of the snap-fitting groove 17*d*.

According to the embodiment that is described, the snap-fitting projection 21 is supported by the plug casing 31 and the snap-fitting groove 17*d* is formed on the pin 17. Of course, an alternative can be contemplated, according to which the snap-fitting projection is supported by the pin 17 and the snap-fitting groove is provided in the plug casing 31.

Furthermore, the snap-fitting projection 21 has a curved shape matching the shape of the snap-fitting groove 17*d* produced on the cylindrical periphery of the pin 17. In particular, the snap-fitting projection 21 can comprise:

- an inlet portion 21*a* designed to conform to the shape of the end 17*e* of the pin 17 (see FIG. 2*b*); and
- a retention portion 21*b* configured to radially come into abutment against an inner wall of the pin 17 demarcating the snap-fitting groove 17*d*, so as to limit the translation travel of the pin 17 (see FIG. 2*e*).

With reference to FIGS. 3*a* to 3*c* more specifically, the inlet portion 21*a* can have a frustoconical surface. This frustoconical surface is, for example, generated by a generating line forming an angle α of less than 45°, preferably of the order of 15° to 35° with the assembly direction D (see FIG. 3*c*). This angular range is selected so as to facilitate the descent of the snap-fitting projection 21, relative to the arrangement of the elements on the figures, when the pin 17 slides on this inlet portion 21*a*. The inlet portion 21*a* therefore has a slope ascending toward the retention portion 21*b*, relative to the arrangement of the elements in FIG. 3*c*. This slope extends over a distance d' of the order of 0.5 to 2 mm.

For its part, the shape of the retention portion 21*b* matches the shape of the snap-fitting groove 17*d* (shown in FIGS. 2*a* to 2*e*). The retention portion 21*b* can have a cylindrical surface. This cylindrical surface is generated, for example, by a generating line parallel to the assembly direction D.

Furthermore, the snap-fitting mechanism 7 is designed so as to be activated or triggered when the pin 17 of the base 5 is in the end of travel position in the housing 33 of the plug casing 31, as shown in FIG. 2*e*. To this end, the snap-fitting mechanism 7 comprises one or more return components 23 configured to urge one of the snap-fitting elements toward the engagement position, allowing engagement with the matching snap-fitting element when the base polarizing means is in the end of travel position.

The component or each return component 23 is, for example, produced by a spring, in particular a helical spring. In the example shown, a single return component 23, produced in the form of a spring, is shown. According to the embodiment that is described, the spring 23 is configured to urge the snap-fitting element supported by the plug casing 31, in this example the snap-fitting projection 21, to a position projecting into the passage of the pin 17 in the plug casing 31. Thus, on assembly, the pin 17, and in particular the end 17*e* thereof, presses on this snap-fitting element, in this example the snap-fitting projection 21, so as to lower or stow it further inside the housing of the plug casing 31. In particular, the pin 17 slides against the inlet portion 21*a* of the snap-fitting projection 21, which is the first portion of the snap-fitting projection 21 in contact with the end of the pin 17 during assembly, and presses on the snap-fitting projection 21.

To this end, the spring 23 can be a compression spring designed to be able to compress when the pin 17 presses on the snap-fitting element supported by the plug casing 31, in this example the snap-fitting projection 21, during assembly. More specifically, the spring 23 can be designed so as to be relaxed in a rest position for urging, in this example, the snap-fitting projection 21 projecting into the passage of the pin 17, and so as to compress when a compression force is exerted on the spring 23.

The pin 17 can then continue its course. Under the thrust of the spring 23, the snap-fitting projection 21 is taken to the engagement position and is engaged in the snap-fitting groove 17*d*, as shown in FIG. 2*e*. As is more clearly shown in FIG. 3*b*, the snap-fitting projection 21 extends over an angular sector S of the order of 146°. The retention portion 21*b* is then in abutment against an inner wall of the pin 17 demarcating the snap-fitting groove 17*d* (see FIG. 3*c*) and thus limits the translation travel of the pin 17 in the assembly direction D.

With respect to the mechanism 9 for decoupling the base casing 51 and the plug casing 31, it comprises a pushbutton 25 freely mounted in the plug casing 31 (see FIGS. 2*a* to 2*e*). To this end, the plug casing 31, and in particular the housing 33, is designed to be able to accommodate the movable pushbutton 25. Furthermore, the pushbutton 25 is arranged partially projecting on the plug casing 31 so as to be able to be activated from outside the connector assembly 1. According to the illustrated embodiment, the pushbutton 25 is mounted so as to project on a large lateral face of the plug casing 31. The pushbutton 25 is freely mounted radially relative to the direction D for assembling the pin 17 in the plug casing 31. Of course, by way of an alternative, the pushbutton 25 can be arranged on a small lateral face of the plug casing 31, for example, on the rear face 31*b* of the plug casing 31.

According to yet another alternative, not shown, the pushbutton 25 can be doubled by arranging another pushbutton on the face opposite the face supporting the push button 25. In this case, in order to disconnect the two plug 31 and base 51 casings, the two sides are pinched.

The one or each pushbutton 25 comprises:

- an activation zone 25*a* arranged projecting on the plug casing 31; and
- a body 25*b* arranged inside the plug casing 31.

The activation zone 25*a* is an outer part of the pushbutton 25, on which a user can press and which projects outside the plug casing 31. This activation zone 25*a* can extend over a distance of the order of 2 to 4 mm, preferably of the order of 3.55 mm when it is fully projecting.

In the example shown in FIGS. 2*a* to 3*c*, the pushbutton 25 has a shoulder between the activation zone 25*a* and the body 25*b* of the pushbutton 25. The body 25*b* of the pushbutton 25 has a diameter that is greater than that of the activation zone 25*a*.

In a complementary manner, the plug casing 31 has an opening 26 (FIGS. 2*a* to 2*e*) extending transversely inside the plug casing 31, in which the body of the button 25*b* is arranged and opening onto a hole 27 with a diameter that is less than that of the opening 26, with this hole 27 being arranged on the outer wall of the plug casing 31. The diameter of the hole 27 is provided so as to be able to be passed through by the activation zone 25*a* of the pushbutton 25, but it is less than the diameter of the body 25*b*, thus preventing said body from being removed through the hole 27.

Furthermore, as is more clearly shown in FIGS. 3*a* to 3*c*, an orifice 29 is arranged in the body 25*b* of the pushbutton 25. This orifice 29 is provided to receive the end 17*e* of the pin 17 in the end of travel position. Furthermore, the body 25*b* of the pushbutton 25 can have a protuberance 25*c* extending radially on the side opposite the activation zone 25*a* and the orifice 29.

According to the first alternative embodiment, the pushbutton 25 can further comprise a base plate 25*d* (see FIG. 3*a*). The base plate 25*d* is arranged opposite the activation zone 25*a*. The protuberance 25*c* extends, in this example, toward the base plate 25*d*. The base plate 25*d* is fastened or held in the plug casing 31, as can be seen in FIGS. 2*a* to 2*e*. The fastening or the retention can be provided by any suitable means. According to the illustrated example, the base plate 25*d* is fixedly mounted, for example, by being tightly mounted in the plug casing 31. In the example shown in FIGS. 2*a* to 2*e*, the base plate 25*d* of the pushbutton 25 can be mounted flush with the outer wall of the plug casing 31. By way of a variant, the base plate can form an integral part of the plug casing 31.

Furthermore, according to the embodiment that is described, the pushbutton 25 also belongs to the snap-fitting mechanism 7. To this end, the snap-fitting projection 21 belongs to the push button 25. More specifically, the snap-fitting projection 21 is produced as a single part with the pushbutton 25. The snap-fitting projection 21 is, according to the illustrated embodiment, formed on an inner wall of the body 25*b* of the pushbutton 25, i.e. on the side facing the orifice 29. The snap-fitting projection 21 projects into this orifice 29. According to the embodiment that is described, the spring 23 also belongs to the pushbutton 25. The spring 23 is mounted on the body 25*b* of the pushbutton 25 opposite the activation zone 25*a*. The spring 23 is therefore mounted between the body 25*b* and the base plate 25*d* of the pushbutton 25. In particular, the spring 23 is connected by one end to the body of the pushbutton 25 and by another end to the base plate 25*d* of the pushbutton 25. Consequently, the base plate 25*d* forms a fixed part and the activation zone 25*a* and the body 25*b* of the pushbutton 25, and optionally the protuberance 25*c* formed on the body 25*b*, form a movable part of the pushbutton 25 relative to the fixed base 25*d*. This movable part 25*a*, 25*b*, 25*c* therefore moves between:

- a rest position, or advanced position, in which the activation zone 25*a* completely projects outside the front or outer wall of the plug casing 31; in this position, the snap-fitting projection 21 is in the engagement position, as previously described; and
- a compressed position, or retracted position, in which the activation zone 25*a* is partially stowed inside the opening 26 in the plug casing 31; in this position, the snap-fitting projection 21 is in the disengagement position, as previously described.

A guide for the movement of the pushbutton 25 in the opening 26 of the plug casing 31 also can be provided. In this example, it is a translation movement guide. This guide provides an anti-rotation function.

According to the first alternative embodiment shown in FIGS. 2*a* to 3*c*, a guide for guiding the movement of the movable part 25*a*, 25*b*, 25*c* of the pushbutton 25 can be provided in the vicinity of the base plate 25*d*. As is more clearly shown in FIGS. 2*a* to 2*e*, the base plate 25*d* has a groove 40, in which the protuberance 25*c* of the pushbutton 25 moves during movements of the movable part of the pushbutton 25.

Figure 4A:
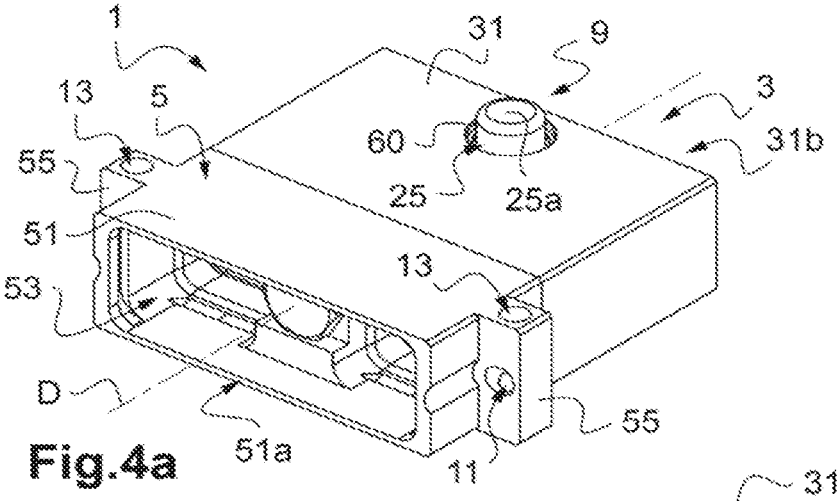
FIG. 4*a* is a perspective view of a connector assembly comprising a pushbutton and a plug casing according to a second alternative embodiment.
Figure 4B:
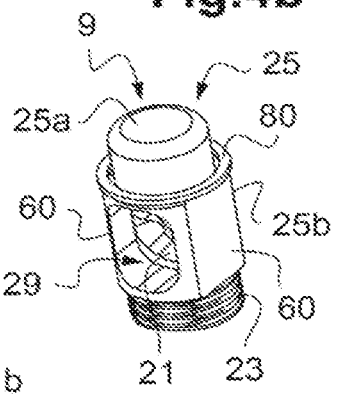
FIG. 4*b* is a perspective view of the pushbutton according to the second alternative embodiment.
Figure 4C:
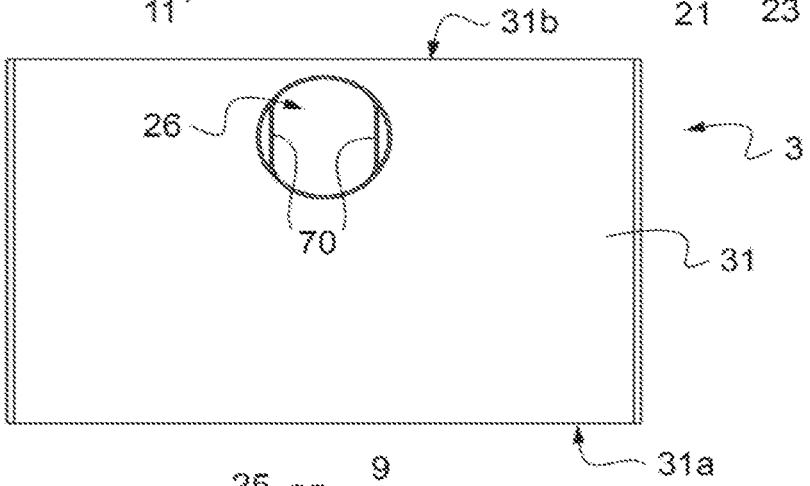
FIG. 4*c* is a top view of the plug casing according to the second alternative embodiment.

According to a second alternative embodiment shown in FIGS. 4*a* to 4*e*, the guide function is provided by flat shapes 60, 70, more clearly shown in FIGS. 4*b* and 4*c*, provided in a complementary manner on the body 25*b* of the pushbutton 25 and the wall of the plug casing 31 demarcating the opening 26.

Advantageously, the flat shapes 60, 70 are provided in pairs. In other words, the body of the pushbutton 25*b* has two opposite flat shapes 60, as is more clearly shown in FIG. 4*b*. Similarly, two opposite flat shapes 70 demarcating the opening 26 are provided in the plug casing 31, with reference to FIG. 4*c*. More specifically, the flat shapes 60 are provided on the solid lateral faces of the body 25*b* of the pushbutton 25 (see FIG. 4*b*) and not on the open faces on which the orifice 29 emerges that is arranged in the body 25*b* of the pushbutton 25. More specifically, it involves outer faces of the pushbutton 25. These flat shaped faces 60 extend in a vertical plane relative to the arrangement of the elements of FIG. 4*b*. In a complementary manner, the flat shaped walls 70 demarcating the opening 26 in the plug casing 31 are arranged so as to be facing flat shaped faces 60 of the body 25*b* of the pushbutton 25 when it is received in the opening 26. In this case, engagement no longer needs to be provided between a protuberance 25*c* and a groove 40 of the base plate 25*d*, as previously described with reference to the first alternative embodiment. The spring 23 can be mounted around a protuberance 25*c*' of the body of the pushbutton 25, which is no longer used to engage with a groove 40. Furthermore, the spring 23 can be fastened directly on a wall of the plug casing 31, without needing to provide a base plate 25*d*, as previously described with reference to the first alternative embodiment. Thus, more generally, the spring 23 is fastened, on the one hand, to the pushbutton 25, more specifically to the body 25*b* and, on the other hand, to the plug casing 31.

During operation, when the pushbutton 25 slides inside the opening 26, the engagement of the flat shapes 60, 70 of the lateral faces of the body 25*b* of the pushbutton 25 and of the walls demarcating the opening 26 in the plug casing 31, provide the translational guidance of the pushbutton 25 and thus provide an anti-rotation function. The remainder of the description with reference to the first alternative embodiment shown in FIGS. 1*a* to 3*c* is applicable to this second alternative embodiment and is not described again.

Furthermore, according to any of the previously described alternative embodiments, a stop also can be provided for holding the pushbutton 25 in place in the opening 26 of the plug casing 31.

Figure 4D:
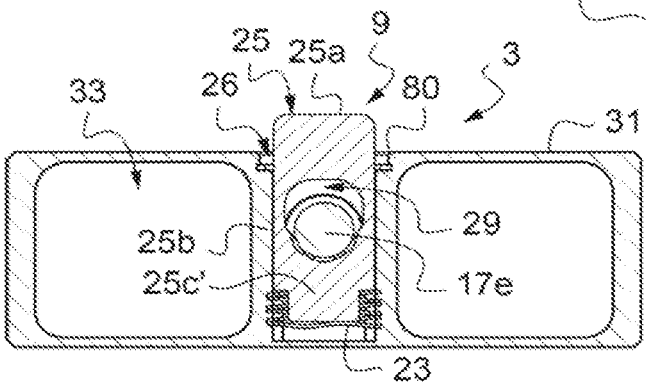
FIG. 4*d* is a transverse section view of the plug casing and of the pushbutton according to the second alternative embodiment.
Figure 4E:
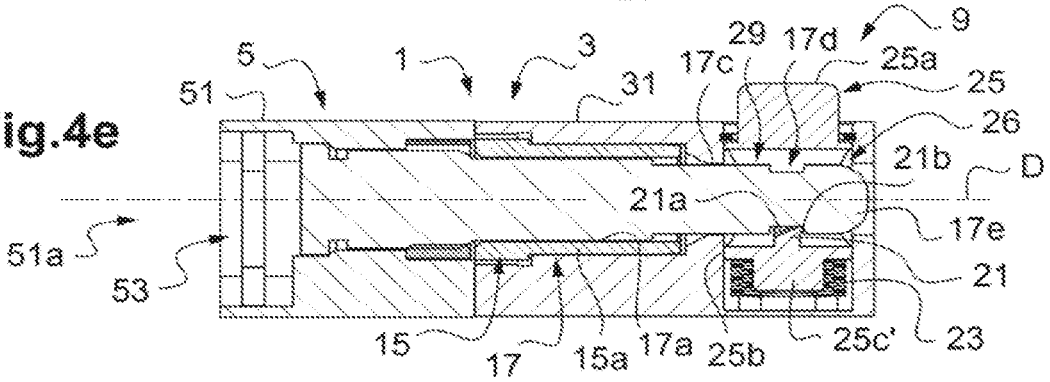
FIG. 4*e* is a longitudinal section view of the connector assembly of FIG. 4*a*.

By way of an example, as shown in FIGS. 4*c* to 4*e*, a stop ring 80 can be mounted on the pushbutton 25, more specifically in the vicinity of the shoulder between the activation zone 25*a* and the body 25*b* of the pushbutton 25.

Method for Connecting and Disconnecting

The method for connecting the plug 31 and base 51 casings as previously described is implemented as follows with reference to all the figures.

In order to mechanically and electrically connect the two plug 31 and base 51 casings, during a first step the two plug 31 and base 51 casings are positioned opposite each other. More specifically, the polarizing means 15, 17, respectively of the plug 3 and of the base 5, are placed facing one another (see FIGS. 1*a*, 1*b*).

The two plug 31 and base 51 casings are plugged in or assembled in the assembly direction D, so that the pin 17 supported by the base 5 is inserted into the socket 15 of the plug 3, as shown in FIG. 2*a*. To this end, the two plug 31 and base 51 casings simply need to be pushed toward each other without requiring other operations. During this assembly, by continuing to push the two casings 31, 51 toward each other, the end 17*e* of the pin 17 exceeds the socket 15 and the stop 35 and engages in the orifice 29 provided in the body 25*b* of the pushbutton 25, as shown in FIG. 2*b*. The end 17*e* of the pin slides on the slope of the frustoconical surface of the inlet portion 21*a* of the snap-fitting projection 21 until it reaches the retention portion 21*b*, as shown in FIG. 2*c*. The force exerted by the end 17*e* of the pin 17 compresses the spring 23 so that the movable part of the pushbutton 25 comprising the snap-fitting projection 21 is lowered, relative to the arrangement of the elements in FIG. 2*c*. The pin 17 thus can continue to its end of travel position. As soon as the snap-fitting groove 17*d* arrives opposite the snap-fitting projection 21 (see FIG. 2*d*), and thus as soon as the end 17*e* no longer exerts a force on this snap-fitting projection 21, said snap-fitting projection is pushed by the spring 23 so as to engage in the snap-fitting groove 17*d*, as shown in FIG. 2*e* or in FIG. 4*e*.

The two plug 31 and base 51 casings are thus locked by snap-fitting in a position whereby they are assembled together and this prevents unintentional decoupling of the plug 31 and base 51 casings.

In order to disconnect or disassemble the two plug 31 and base 51 casings assembled as shown in FIG. 2*e* or 4*e*, the activation zone 25*a* of the pushbutton 25 simply needs to be pressed or, by way of a variant, the activation zones 25*a* of two pushbuttons 25 arranged on opposite faces of the plug casing 31 need to be pressed. The translation movement of the movable part of the pushbutton 25 compresses the spring 23 and the snap-fitting projection 21 is brought to the disengagement position in order to release the snap-fitting groove 17*d*. The two plug 31 and base 51 casings then simply need to be separated from each other in order to decouple them.

Thus, contrary to the solutions of the prior art, the plug 3 does not comprise a central coupling screw. The screwing system is replaced by the snap-fitting mechanism 7 in order to enable locking of the two plug 31 and base 51 casings that are assembled together. In order to connect (or couple) the two plug 31 and base 51 casings, the snap-fitting projection 21 simply snap-fits into the pin 17 when the pin 17 moves inside the plug casing 31. No additional manipulation is required. Furthermore, the spring 23 keeps the snap-fitting projection 21 engaged in the snap-fitting groove 17*d*, so that the casings 31, 51 remain in this locked position. With respect to the decoupling or disconnection of the two casings 31, 51, a pressure simply needs to be exerted on the activation zone 25*a* of the pushbutton 25 in order to release the pin 17 and separate the two casings 31, 51. No specific tooling is required either for the connection or for the disconnection. Furthermore, this allows the two casings 31, 51 to be coupled or uncoupled in a direction parallel to the alignment of the male electric contacts that are particularly received in the modules (not shown) of the plug 31 and base 51 casings, without damaging them and without any random movements. The connector assembly 1 is therefore ergonomic and easy to use, with intuitive connection or disconnection.

The invention claimed is:

1. An electrical connector assembly, comprising:

a plug comprising a plug casing defining a housing, and a plug polarizing means arranged in the housing;

a base comprising a base casing configured to be assembled with the plug casing, the base casing comprising a base polarizing means matching the plug polarizing means and configured to fit together with the plug polarizing means during assembly of the plug and base casings; and a snap-fitting mechanism supported by the base polarizing means and by the plug casing, and configured to be activated when the base polarizing means is in an end of travel position in the housing of the plug casing, wherein the snap-fitting mechanism comprises:

matching snap-fitting elements supported by the base polarizing means and by the plug casing; and at least one return component configured to urge one of the matching snap-fitting elements to an engagement position, allowing engagement with the one of the matching snap-fitting elements when the base polarizing means is in the end of travel position, wherein the snap-fitting elements comprise:

at least one snap-fitting projection; and at least one matching snap-fitting groove, wherein the at least one snap-fitting projection is configured to engage in the at least one snap-fitting groove when the base polarizing means is in the end of travel position, wherein the assembly further comprises a mechanism configured to uncouple the base casing and the plug casing, comprising at least one pushbutton freely mounted in the plug casing and arranged partially projecting on the plug casing so as to be configured to be activated from outside the connector assembly, and wherein the at least one return component and the at least one snap-fitting projection belong to the at least one pushbutton.

2. The electrical connector assembly as claimed in claim 1, wherein the at least one return component is configured to urge the one of the snap-fitting elements supported by the plug casing to the engagement position, in which the one of the snap-fitting elements is projecting into a passage of the base polarizing means in the plug casing so that on assembly the base polarizing means is configured to press on the one of the snap-fitting elements and to continue into the passage.

3. The electrical connector assembly as claimed in claim 1, wherein the base polarizing means is configured to fit together with the plug polarizing means by translation movement in an assembly direction, and wherein the snap-fitting elements are configured to mutually engage radially relative to the assembly direction when the base polarizing means is in the end of travel position.

4. The electrical connector assembly as claimed in claim 1, wherein the at least one snap-fitting projection is supported by the plug casing and the at least one matching snap-fitting groove is formed on the base polarizing means.

5. The electrical connector assembly as claimed in claim 4, wherein the base polarizing means has an outer profile of cylindrical shape, and wherein the snap-fitting projection has a curved shape matching the shape of the at least one matching snap-fitting groove produced on the cylindrical periphery of the base polarizing means.

6. The electrical connector assembly as claimed in claim 1, wherein the at least one snap-fitting projection comprises:

an inlet portion configured to be a first portion of the at least one snap-fitting projection in contact with an end of the base polarizing means during assembly and configured to conform to a shape of the end of the base polarizing means; and a retention portion configured to come into abutment against an inner wall of the base polarizing means demarcating the at least one matching snap-fitting groove, under a thrust of the at least one return component, so as to limit a translation travel of the base polarizing means.

7. The electrical connector assembly as claimed in claim 6, wherein the inlet portion has a frustoconical surface, and wherein the retention portion has a cylindrical surface.

8. The electrical connector assembly as claimed in claim 7, wherein the frustoconical surface is generated by a generating line forming an angle ($\alpha$) of less than 45° with an assembly direction.

9. The electrical connector assembly as claimed in claim 7, wherein the frustoconical surface is generated by a generating line forming an angle ($\alpha$) of 15° to 35° with an assembly direction.

10. The electrical connector assembly as claimed in claim 1, wherein the at least one pushbutton is freely mounted radially relative to a direction for assembling the base polarizing means in the plug casing.

11. The electrical connector assembly as claimed in claim 1, wherein the at least one pushbutton comprises:

an activation zone arranged projecting on the plug casing; and a body arranged inside the plug casing and having an orifice configured to receive an end of the base polarizing means in the end of travel position.

12. The electrical connector assembly as claimed in claim 1, wherein the plug polarizing means is in a form of a socket and the base polarizing means is in a form of a pin, which is configured to be received inside the socket when the base casing and the plug casing are coupled together.

* * * * *